US010631642B2

(12) United States Patent
Zhu

(10) Patent No.: US 10,631,642 B2
(45) Date of Patent: Apr. 28, 2020

(54) ELECTRIC ROCKING CHAIR AND SWING BASED ON FRICTION PAIR STRUCTURE

(71) Applicant: Xuan Zhu, Guangdong (CN)

(72) Inventor: Xuan Zhu, Guangdong (CN)

(73) Assignee: Xuan Zhu, Guangdong (CN)

( * ) Notice: Subject to any disclaimer, the term of this patent is extended or adjusted under 35 U.S.C. 154(b) by 0 days.

(21) Appl. No.: 16/086,638

(22) PCT Filed: Jul. 11, 2017

(86) PCT No.: PCT/CN2017/092425
§ 371 (c)(1),
(2) Date: Sep. 20, 2018

(87) PCT Pub. No.: WO2018/032908
PCT Pub. Date: Feb. 22, 2018

(65) Prior Publication Data

US 2019/0082844 A1 Mar. 21, 2019

(30) Foreign Application Priority Data

Aug. 16, 2016 (CN) ..... 2016 1 0675797

(51) Int. Cl.

| | |
|---|---|
| ***A47C 3/02*** | (2006.01) |
| ***A47C 3/025*** | (2006.01) |
| ***A47C 3/029*** | (2006.01) |
| ***A47C 7/00*** | (2006.01) |
| ***A47C 7/02*** | (2006.01) |
| ***A47C 7/62*** | (2006.01) |

(52) U.S. Cl.
CPC ..... *A47C 3/0251* (2018.08); *A47C 3/029* (2013.01); *A47C 7/002* (2013.01); *A47C 7/02* (2013.01); *A47C 7/62* (2013.01)

(58) Field of Classification Search
CPC ..... A47C 3/0251; A47C 3/02; A47C 3/027; A47C 7/002; A47C 7/02; A47C 7/62
USPC ..... 297/260.2
See application file for complete search history.

(56) References Cited

U.S. PATENT DOCUMENTS

| | | | | |
|---|---|---|---|---|
| 2,845,635 A * | 8/1958 | Eyer | ..... | A47D 9/02 5/109 |
| 3,019,052 A * | 1/1962 | Zawadzki | ..... | A47C 3/027 297/260.2 |
| 8,857,907 B2 * | 10/2014 | Nagamitsu | ..... | A47C 3/02 297/217.4 |

(Continued)

FOREIGN PATENT DOCUMENTS

| | | |
|---|---|---|
| CN | 2186006 | 12/1994 |
| CN | 101172003 | 5/2008 |

(Continued)

OTHER PUBLICATIONS

International Search Report for PCT/CN2017/092425 dated Sep. 6, 2017, 4 pages.

*Primary Examiner* — Mark R Wendell
(74) *Attorney, Agent, or Firm* — Dority & Manning, P.A.

(57) ABSTRACT

An electric glider, rocking chair and swing based on a friction pair structure, the glider comprising: a base configured for standing directly on the ground for load-bearing; a chair for bearing a user; and a friction pair installed between the base and chair and configured for providing relative movement of the base and chair.

17 Claims, 14 Drawing Sheets

(56) References Cited

U.S. PATENT DOCUMENTS

| | | | | |
|---|---|---|---|---|
| 2011/0230272 | A1* | 9/2011 | Pyrce | A47D 9/02 472/119 |
| 2012/0212022 | A1* | 8/2012 | Godbout | A47C 3/02 297/260.2 |
| 2014/0306502 | A1 | 10/2014 | Manuel et al. | |
| 2015/0040694 | A1* | 2/2015 | Tundo | A47C 3/02 74/45 |
| 2015/0196137 | A1 | 7/2015 | Zhao et al. | |
| 2015/0289676 | A1* | 10/2015 | Huntsberger | A47D 13/105 297/258.1 |

FOREIGN PATENT DOCUMENTS

| | | |
|---|---|---|
| CN | 201256811 | 6/2009 |
| CN | 104825009 | 8/2015 |
| CN | 106073257 | 11/2016 |
| DE | 102015100572 | 7/2015 |
| GB | 2522782 A | 8/2015 |
| GB | 2522782 B | 9/2016 |

* cited by examiner

ELECTRIC ROCKING CHAIR AND SWING BASED ON FRICTION PAIR STRUCTURE

CROSS REFERENCE TO RELATED APPLICATIONS

This application is the U.S. National Stage entry of International Application Number PCT/CN2017/092425 filed under the Patent Cooperation Treaty having a filing date of Jul. 11, 2017, which claims priority to Chinese Patent Application No. 201610675797.4, filed on Aug. 16, 2016, which are incorporated herein by reference.

TECHNICAL FIELD

The present invention relates to an electric glider, in particular to an electric glider, rocking chair and swing based on a friction pair structure.

BACKGROUND

There exist two defects in the existing technical solution of the electric glider: one is that a big noise would be generated by transmission of the deceleration box during rocking, and the other is that the swing is not smooth which makes people feel uncomfortable. The above defects lead to no electric glider for adults available on the market. Even the electric glider, swing and rocking chair for babies which are driven by a motor-deceleration box have similar problems. However, the product for babies has a relative lower power, thus the defects are less obvious.

SUMMARY

In order to solve the above technical problems, the present invention aims to provide an electric glider, rocking chair and swing based on a friction pair structure with low noise, comfortable and stable swing.

The technical solution in the present invention is:

an electric glider based on a friction pair structure, comprising:

a base configured for standing directly on the ground for load-bearing;

a chair for bearing a user; and a friction pair installed between the base and chair and configured for providing relative movement of the base and chair.

Further, the chair is movably connected to the base via swing arms at either side of the base.

Further, the electric glider comprises a driving motor, with an output shaft by which the friction pair is driven, for providing force necessary for the relative movement of the base and chair, wherein the friction pair is fixed to one of the base and the chair, and the driving motor is fixed to the other one of the base and the chair.

Further, the electric glider comprises a control circuit board electrically connected to the driving motor to activate and control operation of the driving motor.

Further, the electric glider further comprises a direction sensor arranged in the driving motor for detecting steering of the driving motor, the direction sensor having an output terminal electrically connected to the control circuit board to feedback a steering signal indicative of steering of the driving motor.

Further, the electric glider further comprises a speed sensor arranged in the driving motor for detecting a rotation speed of the driving motor, the speed sensor having an output terminal electrically connected to the control circuit board to feedback a signal indicative of the rotation speed of the driving motor being zero.

Further, the electric glider further comprises a pressure mechanism configured for acting on the driving motor or the friction pair to enable the output shaft of the driving motor and the friction pair to be in close contact with each other, to ensure that the glider is pushed to swing by a static friction force between the output shaft of the driving motor and the friction pair.

In the first preferred technical solution, the friction pair comprises a curved body with both ends fixed to the chair respectively or with one end fixed to the chair.

In the second preferred technical solution, the friction pair is a pedestal having a curved inner surface which is fixed on the base.

In the third preferred technical solution, the friction pair is a linear strip fixed on the base.

The present invention further provides the technical solution which belongs to the same inventive concept as the above electric glider: an electric swing based on a friction pair structure, comprising:

a vertical support stably supportable on the ground with a certain height;

a seat plate for bearing a user;

a friction pair fixed between the vertical support and the seat plate and configured for providing relative movement of the vertical support and the seat plate.

Further, the seat plate is movably connected to the vertical support via a swing arm at either side of the seat plate to enable the seat plate suspended in the vertical support.

Further, the electric swing comprises a driving motor, with an output shaft by which the friction pair is frictionally driven, for providing force necessary for the relative movement of the base and chair, wherein the driving motor is fixed on one of the vertical support and the seat plate, and the friction pair is fixed on the other one of the vertical support and the seat plate.

Further, the electric swing comprises a control circuit board electrically connected to the driving motor to activate and control operation of the driving motor.

Further, the electric swing comprises a direction sensor for detecting steering of the driving motor, the direction sensor having an output terminal electrically connected to the control circuit board to feedback a steering signal indicative of steering of the driving motor.

Further, the electric swing comprises a pressure mechanism configured for acting on the driving motor or the friction pair to enable the output shaft of the driving motor and the friction pair to be in close contact with each other, to ensure that the swing is pushed to swing by a static friction force between the output shaft of the driving motor and the friction pair.

The present invention further comprises another technical solution which belongs to the same inventive concept as the above electric glider: a rocking chair based on a friction pair structure, comprising:

a rocking chair body capable of standing directly on the ground and swinging back and forth under a force;

a thrust cart fixed between the rocking chair body and the ground; and a friction pair arranged on the thrust cart for providing relative movement of the rocking chair body and the ground.

The thrust cart is further arranged with wheels at the bottom of the thrust cart, as well as a driving motor, and a pushing handle, the friction pair being fixed on the thrust cart and frictionally driven by an output shaft of the driving motor, the driving motor being fixed to one end of the pushing handle, the other end of the pushing handle being fixed to the rocking chair body, and the pushing handle being pivotally connected to the thrust cart at an intermediate portion of the pushing handle.

Further, the rocking chair further comprises: a direction sensor arranged in the driving motor for detecting steering of the driving motor, the direction sensor having an output terminal electrically connected to the control circuit board to feedback a steering signal indicative of steering of the driving motor; a pressure mechanism configured for acting on the driving motor or the friction pair to enable the output shaft of the driving motor and the friction pair to be in close contact with each other, to ensure that the rocking chair is pushed to swing by a static friction force between the output shaft of the driving motor and the friction pair.

The advantageous effects of the present invention:

The friction pair is used to replace a deceleration box in a conventional electric glider, and a relatively long path is selected from the swing path of the glider to install the friction pair. During the swing of the glider, the distances between each part of the glider are different. By limiting a part having a relatively long movement distance, making a friction pair along the trajectory which is frictionally driven by the output shaft of a motor, and using the friction force to push the rocking chair to swing, the noise caused by transmission of the electric motor may be maximally reduced.

In addition, the present invention uses a direction sensor to detect the swing cycle and the time point of the swing steering. Only with accurate detection of the swing cycle and the time point of the swing steering can the motor be accurately controlled. By providing an appropriate driving force when appropriate, swinging the glider makes people feel comfortable and natural.

BRIEF DESCRIPTION OF THE DRAWINGS

The specific embodiments of the present invention will be further described as follow with reference to the accompanying drawings.

DETAILED DESCRIPTION

Figure 1:
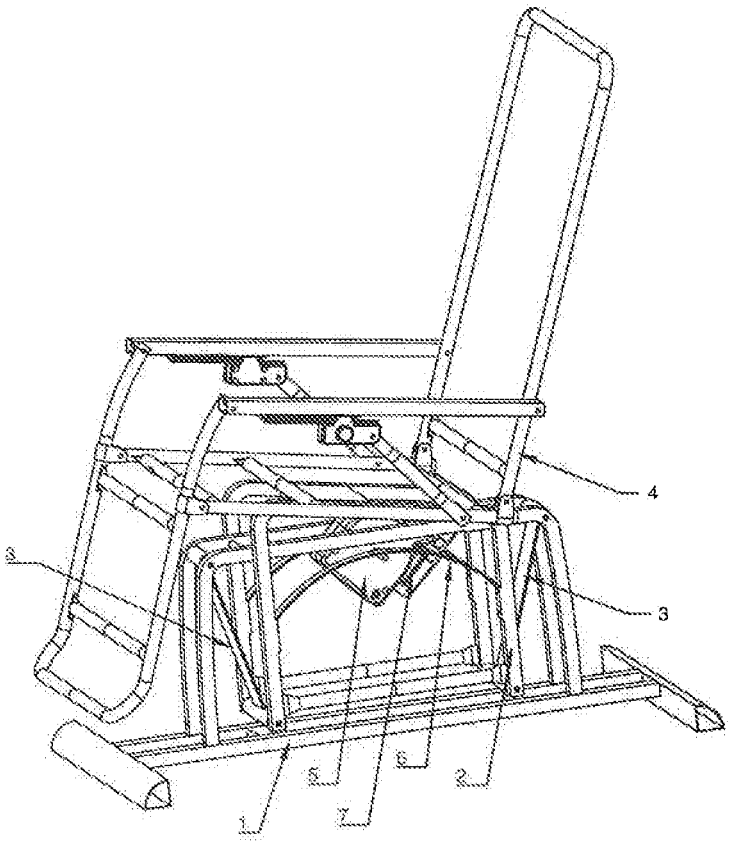
FIG. 1 is a perspective view of an electric glider according to a first embodiment of the present invention.
Figure 2:
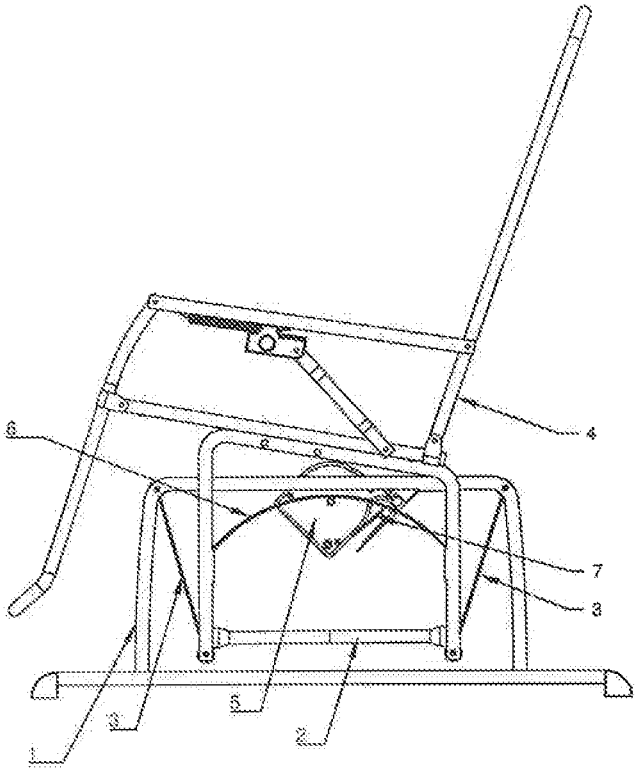
FIG. 2 is a side view of a glider chair according to a first embodiment of the present invention.

As shown in FIGS. 1-2, the first embodiment of the present invention provides an electric glider based on a friction pair structure, comprising:

a base 1, which, as a carrier portion of the entire electric glider, stands directly on the ground for load-bearing;

a seat support 2, which is movably connected (hinged) to the base 1 at either side thereof via a swing arm 3 respectively, so that the seat support 2 is suspended within the base 1, and the seat support 2 can swing back and forth with the swing arm 3 within the base 1;

a chair 4 for carrying a user, which is fixed at the top of the seat support 2 to swing synchronously with the seat support 2;

a driving motor 5 fixed on the base for providing force necessary for swing; the driving motor 5 is preferably a brushless DC motor or a brushed DC motor;

a friction pair 6, which is formed as a curved body fixed to the seat support 2 at either end thereof and frictionally driven by an output shaft of the driving motor 5. The material of curved body surface is selected from polyurethane (PU) or polyvinyl chloride (PVC) soft rubber, which have high friction coefficient and good elasticity. The high friction coefficient helps to prevent the friction pair 6 from slipping, and the good elasticity can reduce the energy loss of the friction pair 6;

a pressure mechanism 7 configured for acting on the driving motor 5 to enable the output shaft of the driving motor 5 and the friction pair 6 to be in close contact with each other, so that to ensure that the static friction force between the output shaft of the driving motor 5 and the friction pair 6 can push the glider to swing. In this embodiment, a torsion spring is used for the pressure mechanism 7, but other pressure mechanisms such as shrapnel or pressure spring are also applicable to this technical solution;

a control circuit board, which is electrically connected to the driving motor 5 to activate and control the operation of the driving motor 5.

By applying an activating signal to the control circuit board via a switch or a remote control, the circuit board outputs instructions to control the rotation of the driving motor 5 to form a transmission from the output shaft of the driving motor 5 to the friction pair 6, so that the seat support 2 and chair 4 which are fixed to the friction pair 6 swing back and forth. During the swing, adjust the swing amplitude or swing time of the glider may be adjusted by further applying an adjustment signal to the control circuit board via the switch or the remote control.

Figure 3:
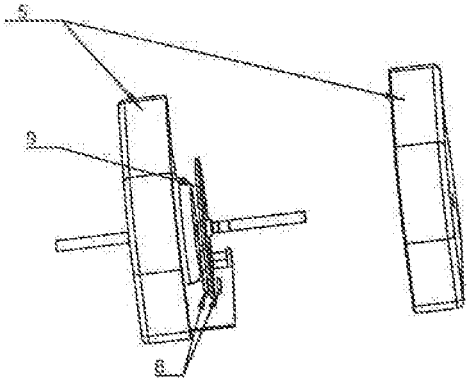
FIG. 3 is an exploded view ① of the driving motor.
Figure 4:
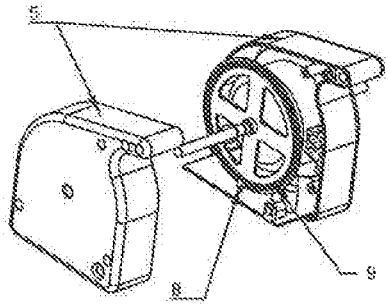
FIG. 4 is an exploded view ② of the driving motor.

As shown in FIG. 3 and FIG. 4, the electric glider further comprises a direction sensor arranged in the driving motor 5 for detecting the steering of the driving motor 5. An output terminal of the direction sensor is electrically connected to the control circuit board to feedback a steering signal indicative of steering of the driving motor 5. The swing cycle and the time point of the swing steering can also be calculated based on the steering signal. However, only with accurate detections of the swing cycle and the time point of the swing steering can the motor be accurately controlled. By providing an appropriate driving force when appropriate, the swing of the glider may make people feel comfortable and natural.

And, the direction sensor comprises mouse pair transistor 8 and a shading flywheel 9 which is concentric installed on the output shaft of the driving motor 5 through its center hole to rotate with the driving motor 5 synchronously. And the launching tube and the receiving tube of the mouse pair transistor 8 are arranged on both sides of the shading flywheel 9. The direction sensor formed by the mouse pair transistor 8 and the shading flywheel 9 is only a preferred embodiment of the present invention, and the existing known direction sensors are also applicable to this technical solution.

Alternatively, replace the above direction sensor with a speed sensor which is arranged within the driving motor for detecting the rotation speed of the driving motor, and an output terminal of the speed sensor is electrically connected to the control circuit board to feedback a signal indicative of the rotation speed of the driving motor being zero. The speed sensor comprises an opposite-type photoelectric switch and a shading flywheel which is concentric installed on the output shaft of the driving motor through its center hole to rotate with the driving motor synchronously. And the launching tube and the receiving tube of the opposite-type photoelectric switch are arranged on both sides of the shading flywheel.

Figure 5:
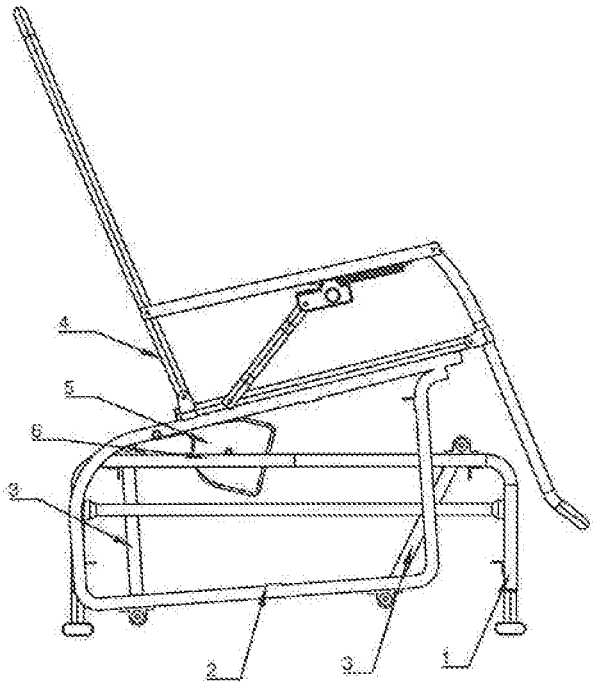
FIG. 5 is a side view of an electric glider according to a second embodiment of the present invention.
Figure 6:
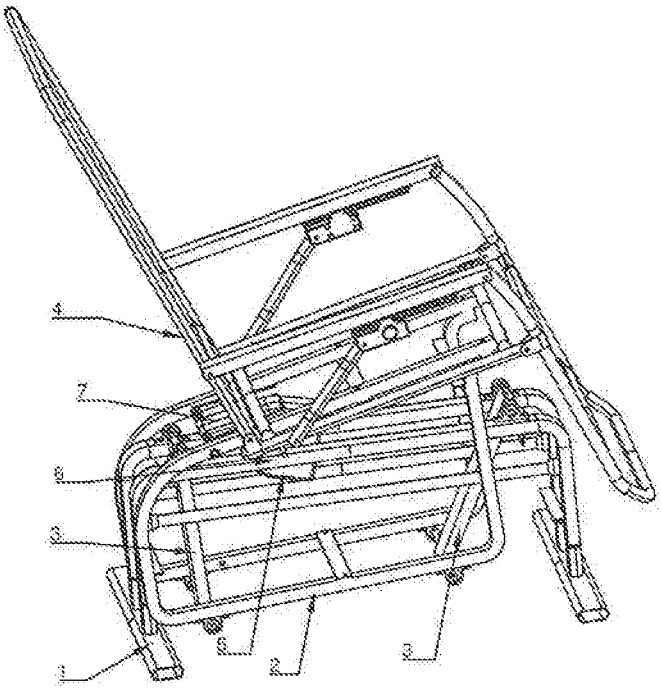
FIG. 6 is a perspective view ① of an electric glider according to a second embodiment of the present invention.
Figure 7:
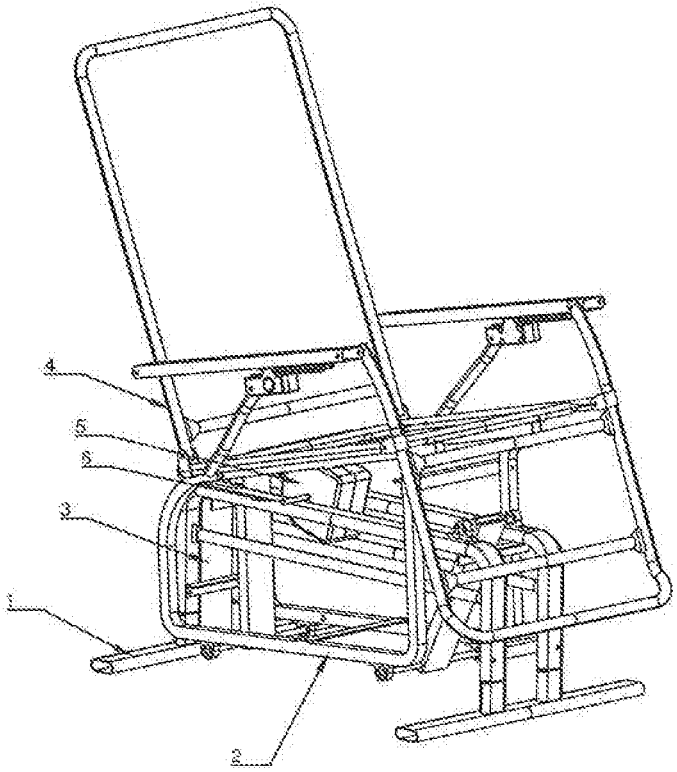
FIG. 7 is a perspective view ② of an electric glider according to a second embodiment of the present invention.

As shown in FIGS. 5-7, the basic structure and principle of the electric glider according to the second embodiment of the present invention are substantially the same as those of the first embodiment, which will not be repeated here, with the exception that the driving motor 5 is fixed on the seat support 2 and the friction pair 6 is a linear strip fixed on the base 1.

Figure 8:
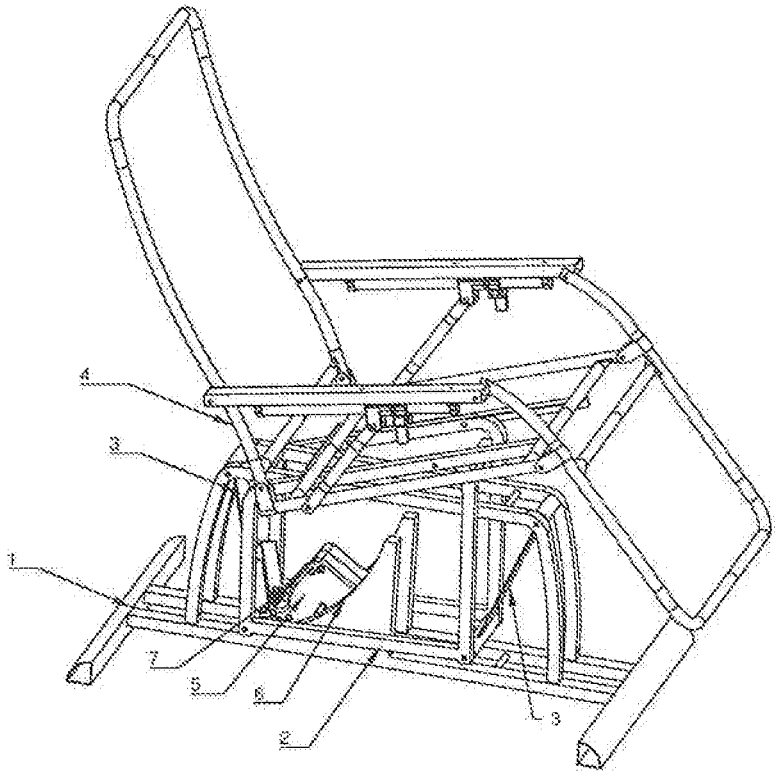
FIG. 8 is a perspective view of an electric glider according to a third embodiment of the present invention.
Figure 9:
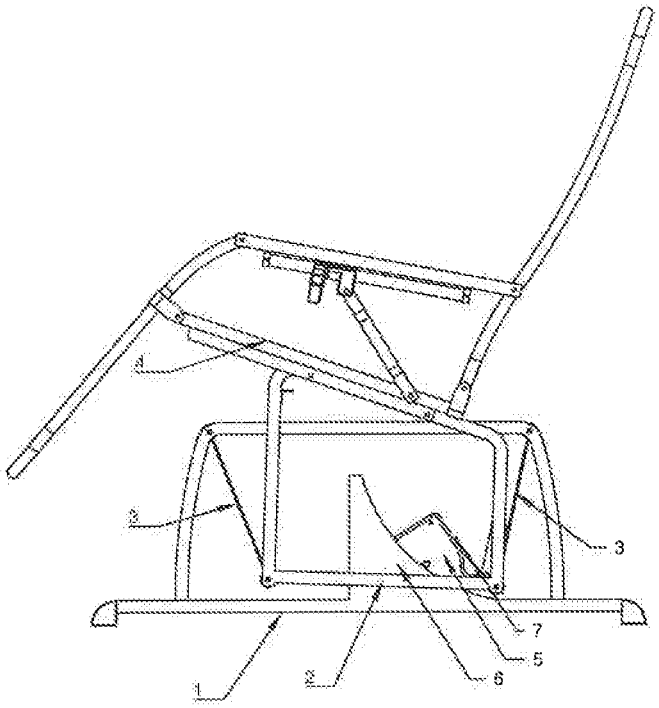
FIG. 9 is a side view of an electric glider according to a third embodiment of the present invention.

As shown in FIGS. 8-9, the basic structure and principle of the electric glider according to the third embodiment of the present invention are substantially the same as those of the first embodiment, which will not be repeated here, with the exception that the driving motor 5 is fixed on the seat support 2 and the friction pair 6 is a pedestal having a curved inner surface which is fixed on the base 1.

Figure 10:
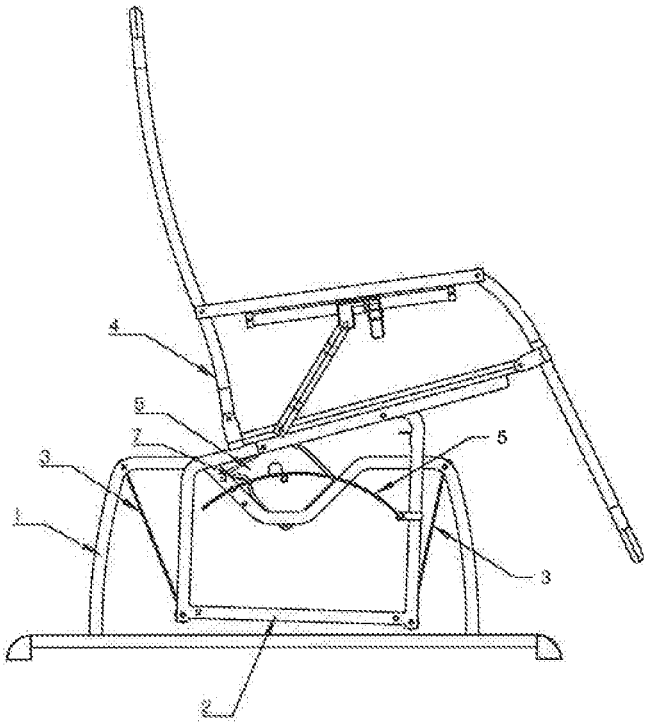
FIG. 10 is a side view of an electric glider according to a fourth embodiment of the present invention.
Figure 11:
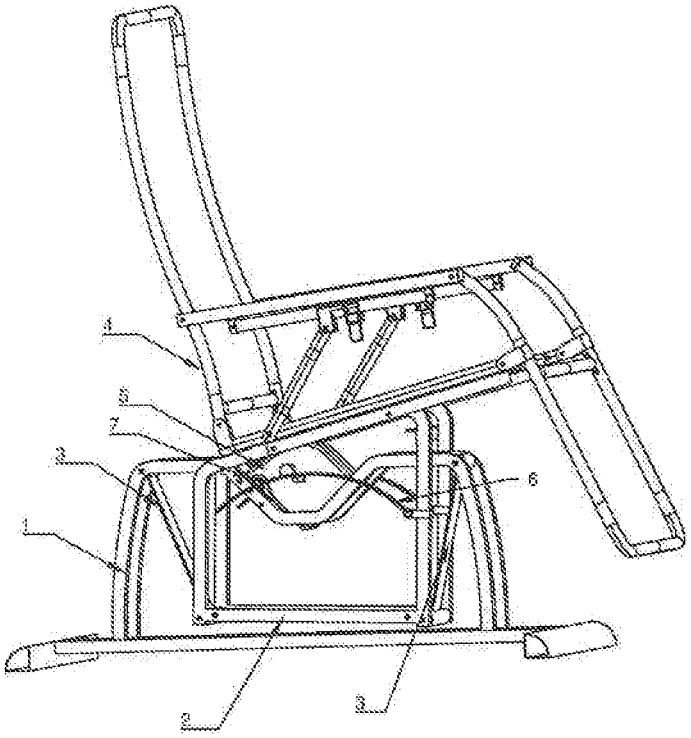
FIG. 11 is a perspective view of an electric glider chair according to a fourth embodiment of the present invention.

As shown in FIGS. 10-11, the basic structure and principle of the electric glider according to the fourth embodiment of the present invention are substantially the same as those of the first embodiment, which will not be repeated here, with the exception that the friction pair 6 comprises a curved body with one end fixed to the seat support 2 and the pressure mechanism 7 is an elastic tablet acting on the friction pair 6 so that the output shaft of the driving motor 5 may be in close contact with the friction pair 6.

Figure 12:
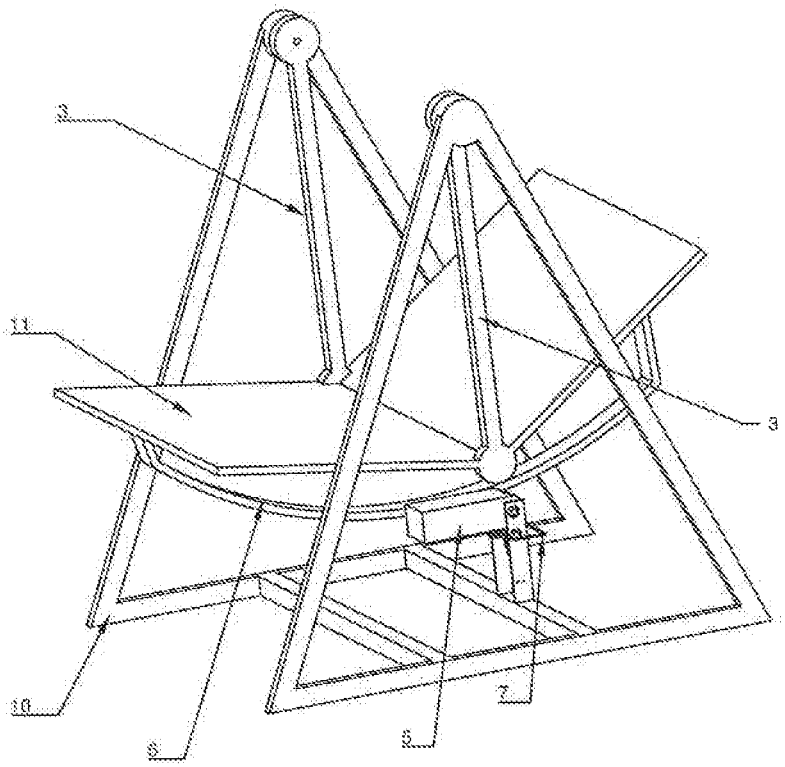
FIG. 12 is a perspective view ① of an electric swing according to a fifth embodiment of the present invention.
Figure 13:
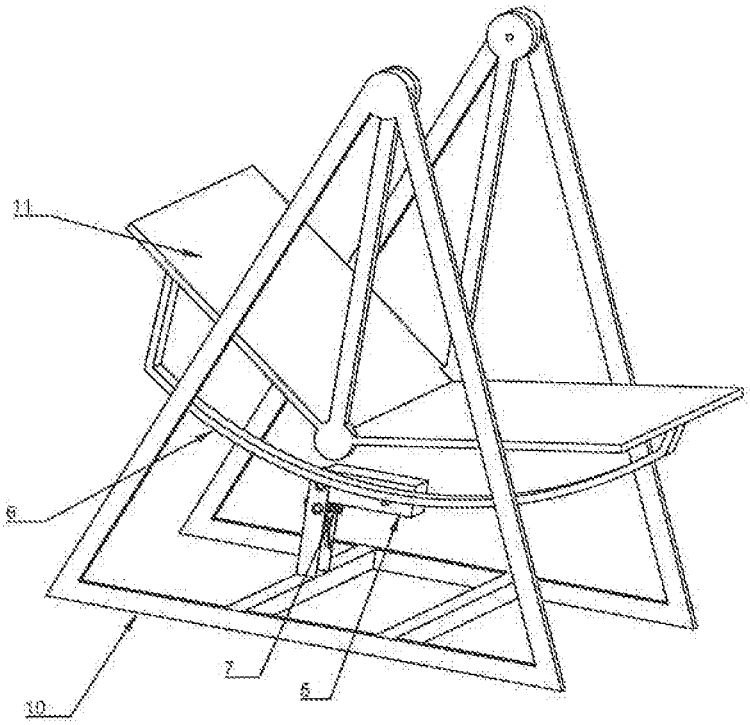
FIG. 13 is a perspective view ② of an electric swing according to a fifth embodiment of the present invention.

As shown in FIGS. 12-13, the fifth embodiment of the present invention which belongs to the same inventive concept as the above electric glider provides an electric swing based on a friction pair structure, comprising:

a vertical support 10 stably supportable on the ground with a certain height for creating a swing space;

a seat plate 11 movably connected to the vertical support 10 at either side thereof via a swing arm 3 to make the seat plate 11 suspended in the vertical support 10;

a driving motor 5 fixed on the vertical support 10 for providing force necessary for swing;

a friction pair 6 frictionally driven by an output shaft of the driving motor 5, the friction pair 6 is fixed on the bottom of the seat plate 11 and comprises an curved body, the material of which is the same as the embodiments described above. Similarly, the positions of the friction pair 6 and the driving motor 5 can be interchanged, that is, the driving motor 5 may be fixed to the bottom of the seat plate 11, the friction pair 6 may be fixed on the vertical support 10;

a control circuit board electrically connected to the driving motor 5 to activate and control the operation of the driving motor 5;

a direction sensor for detecting steering of the driving motor 5 with an output terminal electrically connected to the control circuit board to feedback a steering signal indicative of steering of the driving motor 5;

a pressure mechanism 7 configured for acting on the driving motor 5 or the friction pair 6 TO enable the output shaft of the driving motor 5 and the friction pair 6 to be in close contact with each other. A torsion spring may also be used for the pressure mechanism 7 of this embodiment.

The operating principle of the electric swing of this embodiment is the same as that of the above four gliders, and will not be described here.

Figure 14:
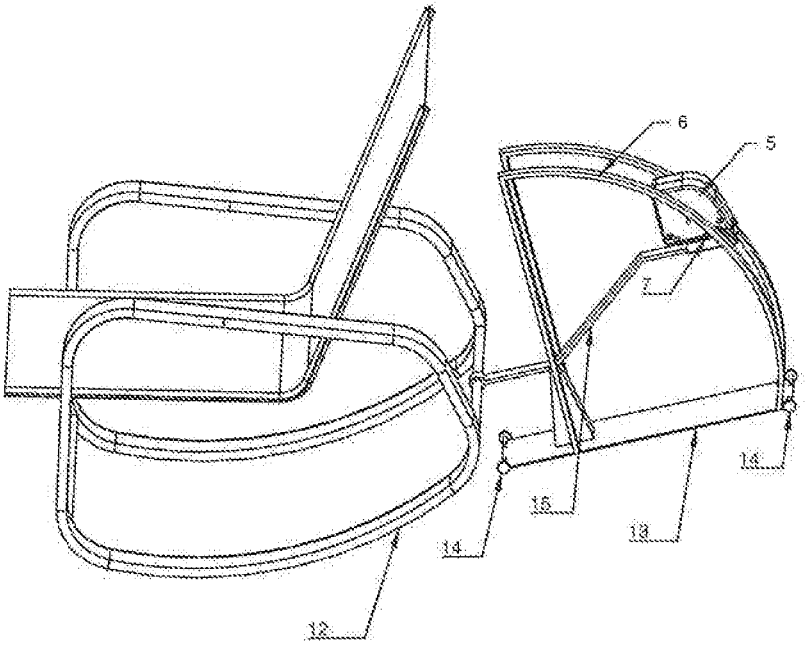
FIG. 14 is a perspective view ① of a rocking chair according to a sixth embodiment of the present invention.
Figure 15:
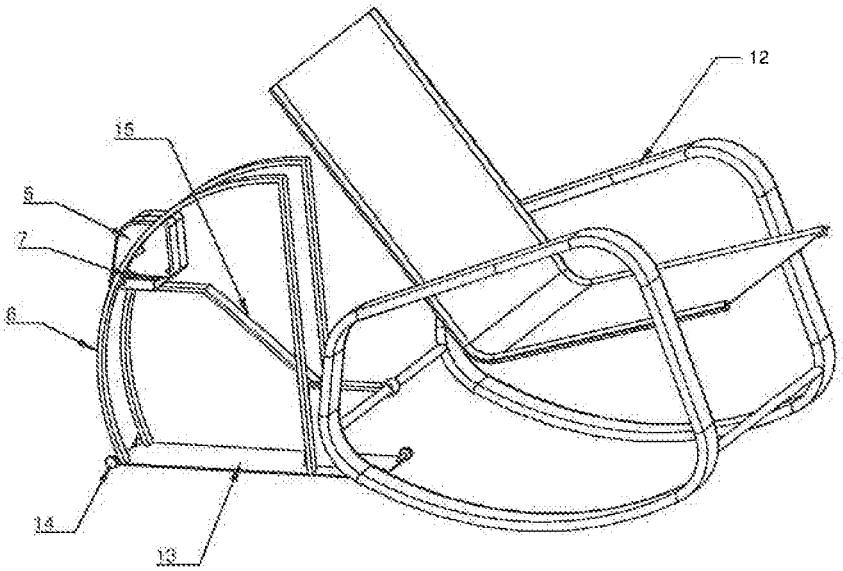
FIG. 15 is a perspective view ② of a rocking chair according to a sixth embodiment of the present invention.

As shown in FIGS. 14-15, the sixth embodiment of the present invention which belongs to the same inventive concept as the above electric glider provides a rocking chair based on a friction pair structure, comprising:

a rocking chair body 12 capable of standing directly on the ground and can be swung back and forth under a force;

a thrust cart 13, which is provided with a plurality of wheels 14 at the bottom thereof and a friction pair 6, a driving motor 5, and a pushing handle 15. The friction pair 6 is fixed on the thrust cart 13 and frictionally driven by an output shaft of the driving motor 5. The driving motor 5 is fixed to one end of the pushing handle 15, the other end of the pushing handle 15 is fixed to the rocking chair body 12, and the pushing handle 15 is pivotally connected to the thrust cart 13 at an intermediate portion thereof.

Similarly, the rocking chair further comprises a direction sensor for detecting steering of the driving motor 5, with an output terminal electrically connected to the control circuit board to feedback an steering signal indicative of steering of the driving motor 5; a pressure mechanism 7 configured for acting on the driving motor 5 to enable the output shaft of the driving motor 5 and the friction pair 6 to be in close contact with each other.

By applying an activating signal to the control circuit board via a switch or a remote control, the control circuit board outputs instructions to control the rotation of the driving motor 5 to form a transmission from the output shaft of the driving motor 5 to the friction pair 6, so that one end of the pushing handle 15 fixed with the driving motor 5 moves upwards or downwards; the intermediate portion of the pushing handle 15 is used as a rotating shaft, thereby the other end of the pushing handle 15 moves opposite to the one end fixed with the driving motor 5 so as to push the rocking chair body 12 to swing, while the swing of the rocking chair body 12 will also bring the thrust cart 13 to move back and forth.

The above descriptions are merely preferred embodiments of the present invention, and the invention is not limited thereto. Any technical solution that achieves the object of the present invention by basically the same means shall all fall within the protection scope of the present invention.

The invention claimed is:

1. An electric glider based on a friction pair structure, comprising:

a base configured for standing directly on the ground for load-bearing;

a seat support movably connected to the base via a swing arm at either side of the seat support for suspending the seat support within the base;

a chair for bearing a user;

a friction pair installed between the base and chair and configured for providing relative movement of the base and chair, a driving motor, with an output shaft by which the friction pair is driven, for providing force necessary for the relative movement of the base and chair;

a pressure mechanism configured for acting on the driving motor or the friction pair to enable the output shaft of the driving motor and the friction pair to be in close contact with each other, to ensure that the glider is pushed to swing by a static friction force between the output shaft of the driving motor and the friction pair.

2. The electric glider based on a friction pair structure according to claim 1, wherein the friction pair is a linear strip fixed on the base.

3. The electric glider based on a friction pair structure according to claim 1, wherein the chair is movably connected to the base via swing arms at either side of the base.

4. The electric glider based on a friction pair structure according to claim 3;

wherein the friction pair is fixed on one of the base and the chair, and the driving motor is fixed to the other one of the base and the chair.

5. The electric glider based on a friction pair structure according to claim 4, further comprising:

a control circuit board electrically connected to the driving motor to activate and control operation of the driving motor.

6. The electric glider based on a friction pair structure according to claim 5, further comprising a direction sensor arranged in the driving motor for detecting steering of the driving motor, the direction sensor having an output terminal electrically connected to the control circuit board to feedback a steering signal indicative of steering of the driving motor.

7. The electric glider based on a friction pair structure according to claim 5, comprising a speed sensor arranged in the driving motor for detecting a rotation speed of the driving motor, the speed sensor having an output terminal electrically connected to the control circuit board to feedback a signal indicative of the rotation speed of the driving motor being zero.

8. The electric glider based on a friction pair structure according to claim 3, wherein the friction pair comprises a curved body with both ends fixed to the chair respectively or with one end fixed to the chair.

9. The electric glider based on a friction pair structure according to claim 3, wherein the friction pair is a pedestal having a curved inner surface which is fixed on the base.

10. An electric swing based on a friction pair structure, comprising:

a vertical support stably supportable on the ground with a certain height;

a seat plate for bearing a user a friction pair fixed between the vertical support and the seat plate and configured for providing relative movement of the vertical support and the seat plate, a driving motor, with an output shaft by which the friction pair is frictionally driven, for providing force necessary for the relative movement of the base and chair;

a pressure mechanism configured for acting on the driving motor or the friction pair to enable the output shaft of the driving motor and the friction pair to be in close contact with each other, to ensure that the swing is pushed to swing by a static friction force between the output shaft of the driving motor and the friction pair.

11. The electric swing based on a friction pair structure according to claim 10, wherein the seat plate is movably connected to the vertical support via a swing arm at either side of the seat plate to enable the seat plate suspended in the vertical support.

12. The electric swing based on a friction pair structure according to claim 11, wherein the driving motor is fixed on one of the vertical support and the seat plate, and the friction pair is fixed on the other one of the vertical support and the seat plate.

13. The electric swing based on a friction pair structure according to claim 12, further comprising:

a control circuit board electrically connected to the driving motor to activate and control operation of the driving motor.

14. The electric swing based on a friction pair structure according to claim 13, further comprising:

a direction sensor for detecting steering of the driving motor, the direction sensor having an output terminal electrically connected to the control circuit board to feedback a steering signal indicative of steering of the driving motor.

15. A rocking chair based on a friction pair structure, comprising:

a rocking chair body capable of standing directly on the ground and swinging back and forth under a force;

a thrust cart fixed between the rocking chair body and the ground; and a friction pair arranged on the thrust cart for providing relative movement of the rocking chair body and the ground, a driving motor, with an output shaft by which the friction pair is frictionally driven, for providing force necessary for the relative movement of the base and chair;

a pressure mechanism configured for acting on the driving motor or the friction pair to enable the output shaft of the driving motor and the friction pair to be in close contact with each other, to ensure that the rocking chair is pushed to swing by a static friction force between the output shaft of the driving motor and the friction pair.

16. The rocking chair based on a friction pair structure according to claim 15, wherein the thrust cart is further arranged with wheels at the bottom of the thrust cart, as well as a pushing handle, the friction pair being fixed on the thrust cart, the driving motor being fixed to one end of the pushing handle, the other end of the pushing handle being fixed to the rocking chair body, and the pushing handle being pivotally connected to the thrust cart at an intermediate portion of the pushing handle.

17. The rocking chair based on a friction pair structure according to claim 16, further comprising:

a direction sensor arranged in the driving motor for detecting steering of the driving motor, the direction sensor having an output terminal electrically connected to the control circuit board to feedback a steering signal indicative of steering of the driving motor.

* * * * *